United States Patent [19]

Malmsten

[11] 4,286,689

[45] Sep. 1, 1981

[54] EXHAUST GAS MUFFLER

[76] Inventor: Sven O. Malmsten, Råberga, S710 15 Vintrosa, Sweden

[21] Appl. No.: 63,677

[22] Filed: Aug. 6, 1979

[30] Foreign Application Priority Data

Aug. 15, 1978 [SE] Sweden ..... 7808659
Jun. 20, 1979 [SE] Sweden ..... 7905427

[51] Int. Cl.[3] ..... F01N 7/02; F01N 1/08
[52] U.S. Cl. ..... 181/232; 181/272
[58] Field of Search ..... 181/264, 268–269, 181/272, 232

[56] References Cited

U.S. PATENT DOCUMENTS

| | | | |
|---|---|---|---|
| 813,203 | 2/1916 | Franquist | 181/264 |
| 992,839 | 5/1911 | Wolle et al. | 181/264 |

FOREIGN PATENT DOCUMENTS

| | | | |
|---|---|---|---|
| 39067 | 4/1936 | Netherlands | 181/264 |
| 150313 | 6/1955 | Sweden | 181/272 |
| 301910 | 9/1954 | Switzerland | 181/269 |
| 364222 | 1/1932 | United Kingdom | 181/264 |

*Primary Examiner*—L. T. Hix
*Assistant Examiner*—Thomas H. Tarcza

[57] ABSTRACT

The invention relates to a muffler, which is suitable for large-scale production and which at a maintained or reduced sound level reduces the pressure drop of the exhaust gases as compared to known mufflers. The muffler comprises an insert of sheet metal cones with their apices directed toward the outlet thereof with the cones having one or a small number of relatively large size gas flow passages. Adjacent cones of the insert are disposed at such a distance relative to one another that the apex of the rear cone, as viewed in the direction of the gas flow, lies downstream of a plane perpendicular to the direction of the axis through the abutment surface to the envelope of the front cone.

4 Claims, 7 Drawing Figures

EXHAUST GAS MUFFLER

BACKGROUND OF THE INVENTION

Mufflers, for example for motor vehicles, often include inserts for dividing and silencing the pulsating flow of exhaust gas. Generally, to provide appropriate silencing, and at the same time a reasonably low pressure drop, such inserts have to be relatively complex and large. To be able to reduce the dimensions of the muffler while maintaining its silencing capacity, fiber inserts, usually constituted of mineral fibers, can be provided in the muffler. The life of such mineral fiber inserts, however, is too short in relation to the life-expectancy of the structure of the muffler itself, especially if it is made of stainless steel, or other corrosion-resistant material. Another drawback of known mufflers is that, normally, different constructions and dimensions of the mufflers have to be available for different engine types.

This invention relates to an exhaust gas muffler, particularly for combustion engines, comprising a tubular envelope, a gas inlet at one end of the envelope, a gas outlet at the other end of the envelope, and between these ends, at least one muffler insert which includes two, or several, spaced apart cones of sheet metal, whose edges substantially closely contact the envelope, and whose axes of symmetry are substantially coaxial to the axis of the envelope.

An object of the present invention is to provide a muffler of simple construction, which without fiber inserts, and without causing unfavorable pressure drop of the exhaust gases, can be manufactured with relatively small dimensions, and at the same time have excellent silencing capacity.

Another object of the present invention is to provide a muffler which can be manufactured of only a few parts, and produced largely automatically, or at least with a simplified assembling procedure.

Still another object of the present invention is to provide a muffler of standard construction, which in a simple manner, by small modifications of its components, can be adapted to different types of engines.

The above-mentioned objects are achieved in mufflers of the above-described type by the fact that at least one sheet metal cone of each insert has at least one or a small number of relatively large gas flow passages, and that the centers of the passages adjacent cones are angularly separated, and that each insert is disposed with the apices of the cones directed toward the muffler outlet, and that adjacent cones of an insert are disposed at a distance from one another such that the apex of the rear cone, as viewed in the direction of the the gas flow, lies downstream of a plane perpendicular to the direction of the axis through the surface of abutment to the envelope of the front cone.

BRIEF FIGURE DESCRIPTION

In order that the invention will be more clearly understood, it will now be disclosed in greater detail with reference to the accompanying drawings, wherein.

DESCRIPTION OF THE PREFERRED EMBODIMENTS OF THE INVENTION

Figure 1:
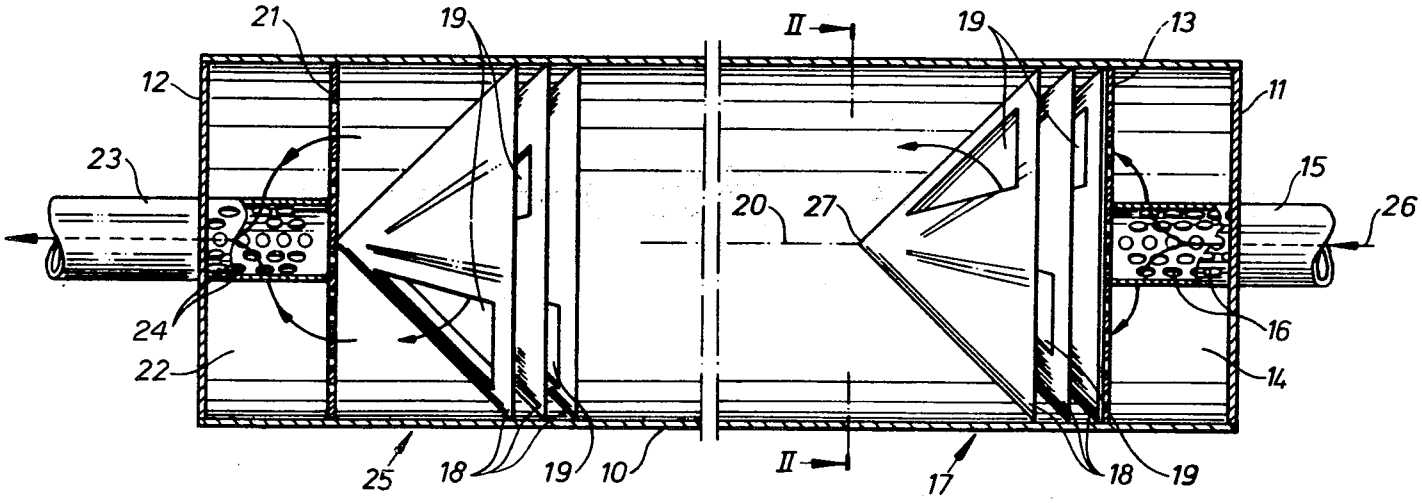
FIG. 1 is a part sectional and a part elevational view of an exhaust gas muffler constructed according to the teachings of the present invention.
Figure 2:
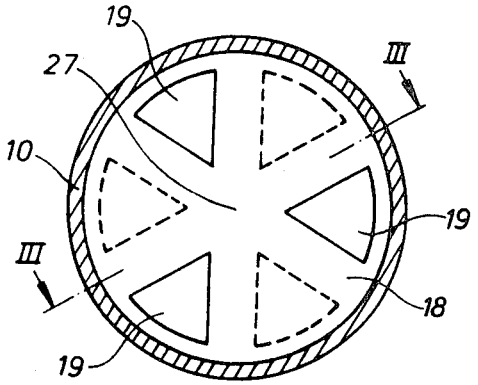
FIG. 2 is a sectional view taken along the lines II—II of FIG. 1.

FIG. 1 shows a muffler which is well-suited for combustion engines, for example motor vehicle engines. The muffler comprises a tubular envelope 10 each end of which is defined and closed by end walls 11 and 12. A perforated baffle 13 forms, together with the end wall 11 and the envelope 10, a gas diffusing chamber 14. A muffler gas inlet tube 15 extends through the end wall 11 to the baffle 13. The part of the tube 15 which is between the end wall 11 and the baffle 13 is provided with a large number of perforations 16.

A first insert 17 in the right hand side of the envelope 10 comprises sheet metal cones 18, in which one is inserted in the other, and are arranged in the envelope 10 inside of and adjacent to the baffle 13, the cones 18 being disposed with their bases facing the baffle 13.

Each sheet metal cone 18 has three gas flow passages Moreover, each passage 19 can include a portion which is perforated in a certain pattern, or is preferably one single port, as seen in the figures. The ports are arranged relative to one another at an angular distance of 120° with respect to the axis 20 of the cone 18, and of the envelope 10. The angle width of the ports is preferably less than 45°, with respect to the axis. Preferably, the ports are in the form of circle sectors, or triangles, with the apex directed to the axis of symmetry 20 of the cone 18 and the envelope 10, the ports being symmetrical relative to a plane through the axis of symmetry of the cone 18.

Adjacent cones 18 are angularly displaced relative to one another through 60° with respect to their ports. The peripheral edges of the cones 18 are substantially closely fixed to the inner wall of the envelope 10. The envelope 10 as well as the cones 18 are suitably circular in cross section, the axes coinciding with the axis of envelope 10.

A perforated second baffle 21 forms a second gas diffusing chamber together with the end wall 12 and the envelope 10. A gas outlet pipe 23 for the muffler extends through the end wall 12 to the baffle 21. The part of the pipe 23 which is between the end wall 12 and the baffle 21 is provided with a large number of perforations 24. A second insert 25 comprising sheet metal cones 18 and inserted one in the other are disposed in the envelope 10 inside of and adjacent to the baffle 21, with the apices of the cones 18 facing the baffle 21. In other respects, the insert 25 is arranged and constructed like the insert 17. However, if desired, the number of cones 18 of each insert can be different. Suitably, the number of cones 18 of an insert is two, but three or even four cones can be used in the assembly.

In actual use, the muffler is intended normally to have gas flowing in the direction of the arrow 26. While the gas diffusing chambers 14 and 22 serve to broaden the gas flow through the envelope.

In a preferred embodiment of the present invention, the sheet metal cones 18 have an outer diameter of 128 mm. and an apex angle of 90°. The ports in the passage 19 are in the form of equilateral triangles with a side length of 36 mm. In mufflers for larger gas flows, ports with a side length of 42 mm. have been tested. The distance between the cones of an insert, as measured at right angles between the surfaces of the cones, amounts to 10–15 mm.

Adjacent cones 18 of an insert are arranged at such relative distances that the apex of the rear cone, as seen in the direction of the gas flow, lies downstream of a plane through the front limitation of the gas flow passages of the front cone, the passages being disposed at equal distances from the apex of the cone.

Each insert can comprise two sheet metal cones 18. If desired, a larger number of each insert can be chosen, but then the increased pressure drop must be considered. Normally, an insert comprises a maximum of four cones 18. The diameter of the envelope, as well as the outer diameter of the cones, can be chosen according to given conditions, but for ordinary motor vehicles, an envelope diameter of 100–150 mm. would be appropriate. Once a certain diameter has been chosen for the envelope of the muffler, the gas pressure drop can be determined by the number of cones 18 included in each insert, and/or by the size of the port area, or the number of ports in each cone.

In a preferred embodiment the distance between the inserts 17 and 25 is 200 mm.

It should be evident, however, that it is also possible to make the muffler with more than two inserts, which are suitably disposed at equal distance relative to one another.

Figure 3:
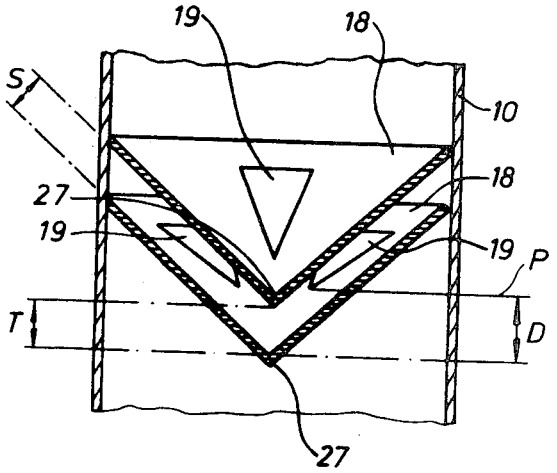
FIG. 3 is a partial sectional view showing a part of a sheet metal cone insert.

As seen in FIG. 3, the ports in the passage 19 are preferably arranged near the base of the cone 18, so that the axial distance between the apex 27 of a cone 18 and a plane P through the front edge of the ports in the passage 19 is greater than the axial distance T between adjacent cones 18.

The perpendicular distance S between the surfaces of two adjacent cones 18 is preferably such that it corresponds to half the gas flow area of a passage 19 divided by the height of this passage, as measured along the generatrix of a cone 18.

Figure 4:
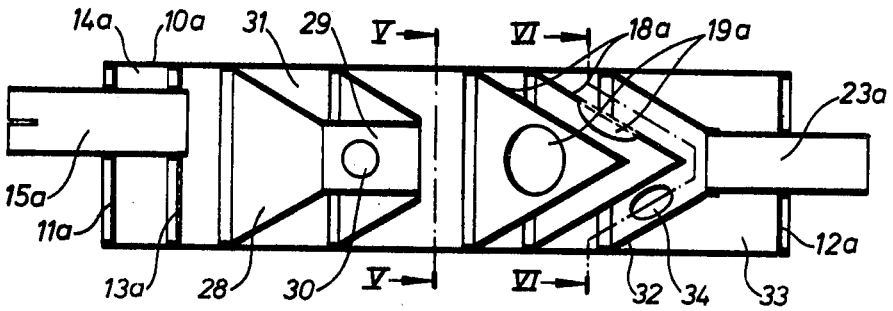
FIG. 4 is a sectional view of another embodiment of the present invention.
Figure 5:
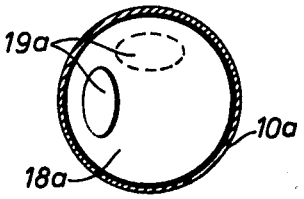
FIG. 5 is a sectional view taken along the lines V—V of FIG. 4.
Figure 6:
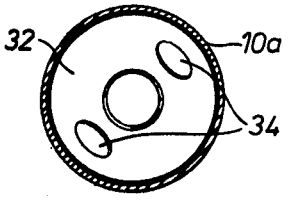
FIG. 6 is a sectional view taken along the lines VI—VI of FIG. 4.

Referring now to the embodiment shown in FIG. 4, the muffler has an envelope 10*a* with an end wall 11*a* through which extends a gas inlet pipe 15*a*. The pipe 15*a* also extends through a perforated baffle 13*a* so that a gas diffusing chamber 14*a* is formed between the baffle 13*a*, end wall 11*a* and envelope 10*a*. The envelope enclosed two sheet metal cones 18*a*, which are coaxial with the axis of the envelope and of which one cone has its apex inside a plane which is perpendicular to the axis of the envelope, and has its extension through the abutment surface to the envelope of the second sheet metal cone. Each cone has a circular gas flow passage or passages 19*a* with an area of substantially the same size as that of the inlet pipe 15*a*. As seen in FIG. 5, the centers of the gas flow passages 19*a* are placed about 90° relative to one another. The envelope further encloses two frustro-cones 28, which with their peripheries, are connected to the envelope 10*a*, and to one another by a central pipe 29 in such a manner that the pipe forms a passage for the gas through the muffler. The pipe 29 has an opening 30 so that a chamber 31 is formed between the cones 28, envelope 10*a* and the pipe 29. The envelope 10*a* furthermore has a sheet metal end cone 32. The latter cone is also frustro-conical, with its smaller end directed toward the outlet, and merges into an outlet pipe 23*a*. In addition, the envelope has an end wall 12*a* at the outlet side. Between this end wall, the outlet pipe 23*a* and the cone 32 a chamber 33 is formed which via two ports 34 in the cone 32 communicates with the part of the muffler, through which the gas flows.

Figure 7:
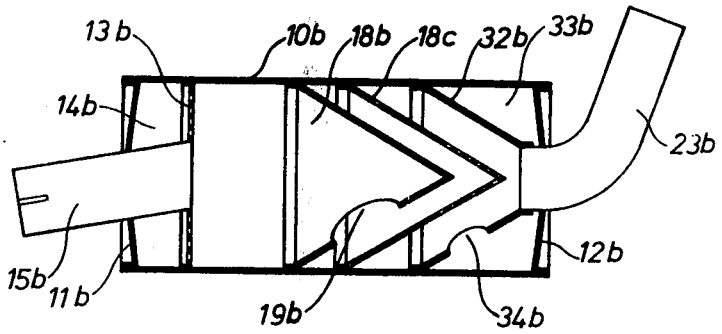
FIG. 7 is a sectional view of a muffler intended principally to be combined with the muffler shown in FIG. 4.

The embodiment shown in FIG. 7, which is mainly intended to co-act with the muffler shown in FIG. 4, comprises, like the above-described embodiments of the invention, an envelope 10*b* with end walls 11*b* and 12*b* and an inlet pipe 15*b* as well as a baffle 13*b*, defining a rear gas diffusing chamber 14*b*. As in the embodiment shown in FIG. 7, a sheet metal end cone 32*b* with ports 34*b* is provided, which together with the envelope and the end wall 12*b* forms a front gas diffusing chamber 33*b*. The embodiment of FIG. 7 is further provided with an outlet pipe 23*b*. In this case, the insert comprises two sheet metal cones 18*b* and 18*c*, the rear cone as seen in the direction of flow, having a gas flow passage 19*b*, and the front cone being perforated.

It should be pointed out that it is possible within the scope of the present invention, for example in the embodiments shown in FIGS. 1 and 4, to divide the envelope into two separate, substantially equal large parts connected to one another via a pipe, in order to make it possible to install the various parts of the muffler at locations which are most suitable with respect to accessibility.

What is claimed is:

1. An exhaust gas muffler comprising a tubular envelope, a gas inlet at one end of said envelope, a gas outlet at the other end of said envelope, said ends of the tubular envelope being closed except for said gas inlet and outlet, at least one muffler insert between said ends including at least two spaced cones, the peripheral edge of each of said cones engaging the inner wall of said tubular envelopes at space locations, the axes of symmetry of said spaced apart cones being substantially coaxial to the central axis of said envelope, the apex of the front cone, as seen in the direction of flow, is inserted in the end cone, the latter being frustro-conical and coaxial with the other cone and directed in the same way, the narrowing part of said end cone opening into said gas outlet, and said end cone having at least one port opening into a front chamber defined by said end cone, said tubular envelope and the end wall of said envelope, a single relatively large gas flow passage in each of said cones, each of said gas flow passages having centers which are angularly separated from the centers of gas flow passages in adjacent cones, each of said inserts being disposed in said tubular envelope with the apices of the cones directed toward said outlet, said cones of each of said insert being so arranged with respect to spacing from one another such that the apex of the rearmost cone, as viewed in the direction of the gas flow, lies downstream of a plane perpendicular to the direction of the axis through the surface of abutment to the envelope of said front cone.

2. An exhaust gas muffler as claimed in claim 1 further comprising a pair of frustro-conical cones adjacent to said gas inlet and within said tubular envelope, a pipe connecting said frustro-conical cones, said pipe being provided with an opening for communication with a chamber, said chamber being defined by surfaces of said frustro-conical cones, and said pipe and tubular envelope.

3. An exhaust gas muffler as claimed in claim 1 further comprising a perforated wall, an end wall and said gas inlet forming a chamber in the rear of said gas muffler adjacent to said gas inlet.

4. An exhaust gas muffler as claimed in claim 1 further comprising an additional muffler combined therewith which comprises a tubular envelope having a rear diffusing chamber and a front diffusing chamber, and two interposed sheet metal cones with their apices directed to said gas outlet, and wherein one of said cones is provided with a relatively large gas flow passage whereas the other cone is perforated with small holes.

* * * * *